US005542668A

United States Patent [19]

Casale et al.

[11] Patent Number: 5,542,668

[45] Date of Patent: Aug. 6, 1996

[54] GAME USING SLOT TRACK RACEWAY

[75] Inventors: Joseph Casale; Salvatore Mucaro, both of Burlington, Conn.

[73] Assignee: Empire of Carolina, Tarboro, N.C.

[21] Appl. No.: 390,649

[22] Filed: Jan. 27, 1995

[51] Int. Cl.[6] ..... A63F 9/14; A63H 18/16

[52] U.S. Cl. ..... 463/59; 104/54; 104/60; 446/44; 463/62

[58] Field of Search ..... 273/86 R, 86 B, 273/86 C, 86 D, DIG 26; 104/53, 54, 55, 60, 63, 64, 67, 69, 79, 80; 446/444, 445, 446, 447

[56] References Cited

U.S. PATENT DOCUMENTS

| | | | |
|---|---|---|---|
| 2,647,693 | 8/1953 | Carver . | |
| 3,209,491 | 10/1965 | Roeper | 273/86 R |
| 3,359,920 | 12/1967 | Iammatteo | 273/86 R |
| 3,466,043 | 9/1969 | McRoskeg et al. | 273/86 B |
| 3,476,389 | 11/1969 | Hok-Shou . | |
| 3,510,631 | 5/1970 | Weinberg . | |
| 3,630,524 | 12/1971 | Cooper . | |
| 3,680,777 | 8/1972 | Arai . | |
| 3,712,615 | 1/1973 | Staats . | |
| 4,082,220 | 4/1978 | Cheng . | |
| 4,084,746 | 4/1978 | Cheng . | |
| 4,095,743 | 6/1978 | Birdsall . | |
| 4,106,695 | 8/1978 | Carella . | |
| 4,231,517 | 11/1980 | Cheng . | |
| 4,241,875 | 12/1980 | Vandenbrink . | |
| 4,316,346 | 2/1982 | Brand . | |
| 4,322,079 | 3/1982 | Cooper . | |
| 4,355,807 | 10/1982 | Prehodka . | |
| 4,388,036 | 6/1983 | Okamoto . | |
| 4,661,080 | 4/1987 | Goldstein . | |
| 5,169,156 | 12/1992 | Smollar . | |
| 5,174,569 | 12/1992 | Ngai | 273/86 R |
| 5,405,080 | 4/1995 | Yeung . | |

FOREIGN PATENT DOCUMENTS

| | | | |
|---|---|---|---|
| 0025304 | 3/1981 | European Pat. Off. | 273/86 R |
| 1036788 | 9/1953 | France . | |

*Primary Examiner*—Vincent Millin
*Assistant Examiner*—William M. Pierce
*Attorney, Agent, or Firm*—Laff, Whitesel, Conte & Saret, Ltd.

[57] ABSTRACT

A slot track raceway has two side-by-side slots for enabling two racing cars to run around a closed loop track. A lap counter individually associated with each closed loop is set to a selected number of laps for establishing the length of a race. Each completion of a lap causes the associated lap counter to count down. When the lap counter counts down to zero, a spring biased hinged track section snaps into alignment with an upwardly inclined ramp so that the car winning the race flies off the track, thus escaping or leaping from the track.

8 Claims, 5 Drawing Sheets

GAME USING SLOT TRACK RACEWAY

BACKGROUND OF THE INVENTION

This invention relates to slot track raceways on which two cars may race each other around a closed loop, with the winning car leaping into the air, while the loser does not escape but must continue around the closed loop track.

Slot tracks are well known games or devices wherein toy cars have a dependent tab which moves through a slot which guides and directs the car around a closed loop. A pair of rails on opposite sides of the slot supplies power to an electric motor in the car. The players have a control which enables them to control the amount of energy which is supplied through the rails and, therefore, the speed of the car riding on those rails.

Hence, two or more players may race their cars over a closed loop track or raceway having a separate slot for each car. As the cars circle the closed loop track, a separate lap counter may count down from a selected number to zero for each car in response to the individual car passing a given point on the track. The first car to cause the lap counter to reach zero is the winner of the race.

The conventional slot track raceway may have a light or flag or in some other way give a visual signal to identify the winner when the race has been won. However, such a light or flag signal is not very flamboyant and, therefore, not in keeping with the exuberance of the children who are racing their cars around the track.

If the manufacturer wishes to continue selling the slot track raceway and the cars that race on it, it is necessary to introduce an element which gives new interest. In general, the more flamboyant the new element, the longer the child will remain interested in the game.

Accordingly, an object of the invention is to provide a spectacular climax at the winning of the slot track race. Here, an object is to couple that climax with events similar to those which the child sees on animated TV, in video games, and the like. In particular, an object is to enable the winner to make a spectacular leap from the track.

In keeping with an aspect of the invention, these and other objects are achieved by providing a closed loop raceway having a plurality of slot tracks so that two or more cars may be raced against each other. First, a lap counter is set to a selected number. As the individual cars race around the closed loop track, a lap counter counts down from the selected number to zero. When a winning car reaches a zero count, a spring biased hinged section of the track flips up to divert the winning car onto a ramp which causes it to fly off the track. In order to achieve a maximum speed on the "escape," the ramp section has a maximum voltage which can not be controlled by the player so that the racing car reaches its maximum speed as it flies through the air.

BRIEF DESCRIPTION OF THE DRAWINGS

A preferred embodiment of this invention shown in the attached drawings, in which.

DESCRIPTION OF THE PREFERRED EMBODIMENT

Figure 1:
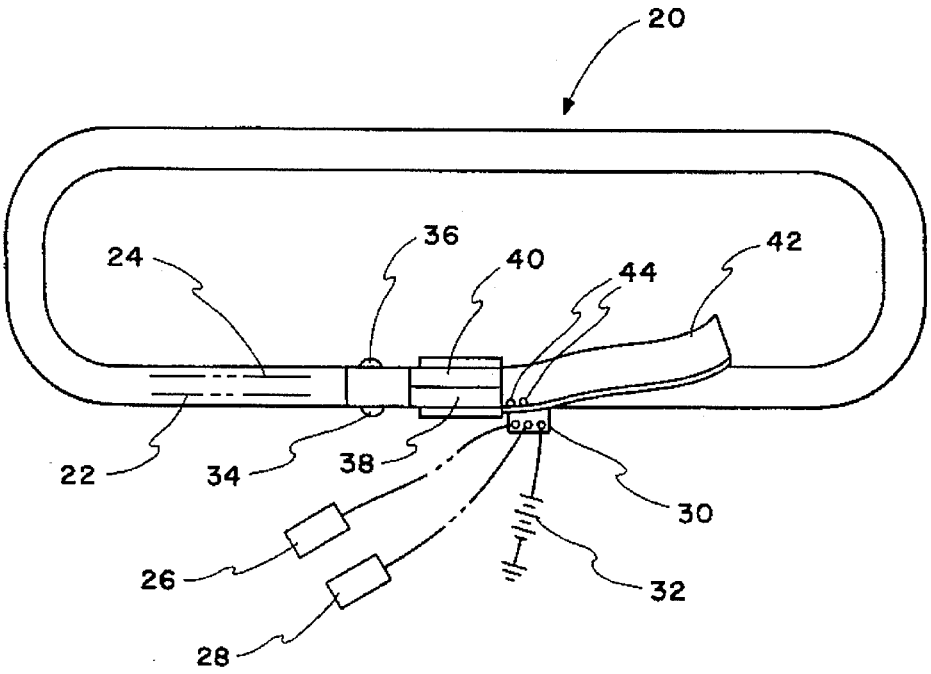
FIG. 1 is a plan view of a slot track raceway with the inventive hinged track section and escape ramp for enabling the winner of a race to leap from the track.

As shown in FIG. 1, a slot track raceway 20 includes a closed loop with a plurality of slots 22, 24 (two slots in this example) so that cars may race each other under the control of individually associated hand held control units 26, 28 which plug into suitable receptacles 30 on the track. A battery 32 or equivalent power supply also plugs into receptacle 30 on the track in order to furnish the energy to drive the racing cars.

A lap counter 34, 36 is individually associated with each slot track 22, 24. When the lap counter is set in order to select the length of a race, the racing cars continue for a selected number of laps, at the end of which one car is declared a winner by its flying off the track from the ramp section.

As long as the cars have not yet caused a lap count down to zero, two spring biased, hinged track sections 38, 40 are locked in a down position so that the racing cars continue to circle around the closed loop raceway 20. When the lap counter counts down to zero and the winning car reaches the hinged track sections 38 or 40, the lock down is released from the hinged track section in the track for that winning car. The resulting release snaps the hinged track section to an up position under the urging of the spring bias so that the winning car goes onto the escape ramp 42. The hinged track section for the losing car stays down so that car does not "escape", but continues around the loop 20.

For powering the car riding in the slot track on the escape ramp, two electrical terminals 44 are connected directly to battery 32. This applies power at full voltage to the escape ramp rails and masks any output from the hand held controllers applying a lower voltage to the ramp rails. This way, the speed controller 26 or 28 has no effect so that the winning car is running at full speed when it travels up and onto the escape ramp in order to cause it to dramatically fly away and "escape" or leap from the track.

Figure 3:
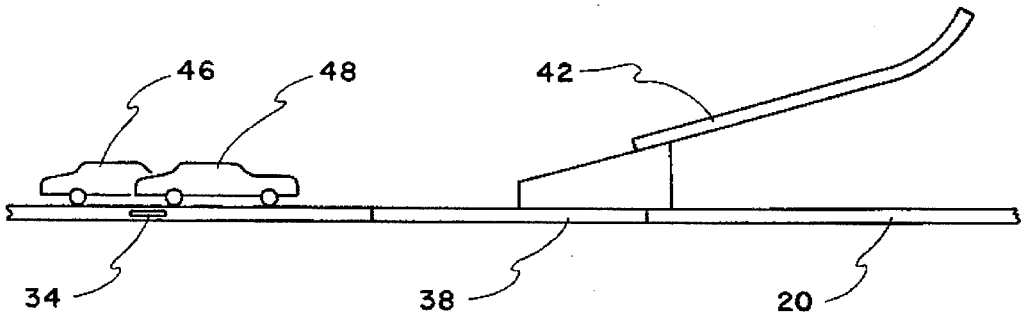
FIG. 3 is a side elevation of the inventive track section during a race while a lap counter is counting down to zero.
Figure 4:
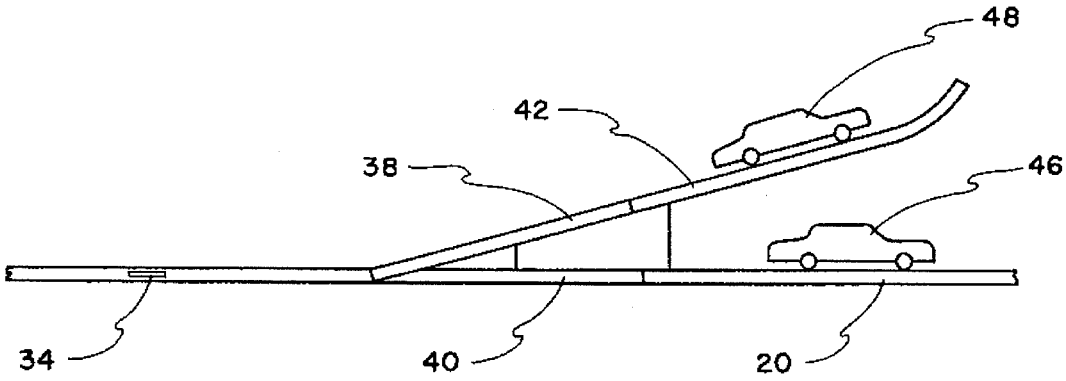
FIG. 4 is a side elevation similar to FIG. 3 with a hinged track section in a raised position so that a winning car is leaping or "escaping" from the raceway while another hinged track section is down so that the loser must continue around the raceway.

FIG. 3 shows two cars 46, 48 racing around the closed loop raceway 20 as they are about to pass under the escape ramp 42 before the lap counter 34, 36 reaches the zero lap count. FIG. 4 shows that car 48 has won the race after the lap counter 34 individually associated with its track reaches its zero count. The spring biased, hinged track section 38 is shown snapped up to an elevated position directing the winning car 48 onto the escape ramp 42, while the other track section 40 remains locked in a down position so that the losing car does not "escape," but continues to run around loop 20.

Figure 2:
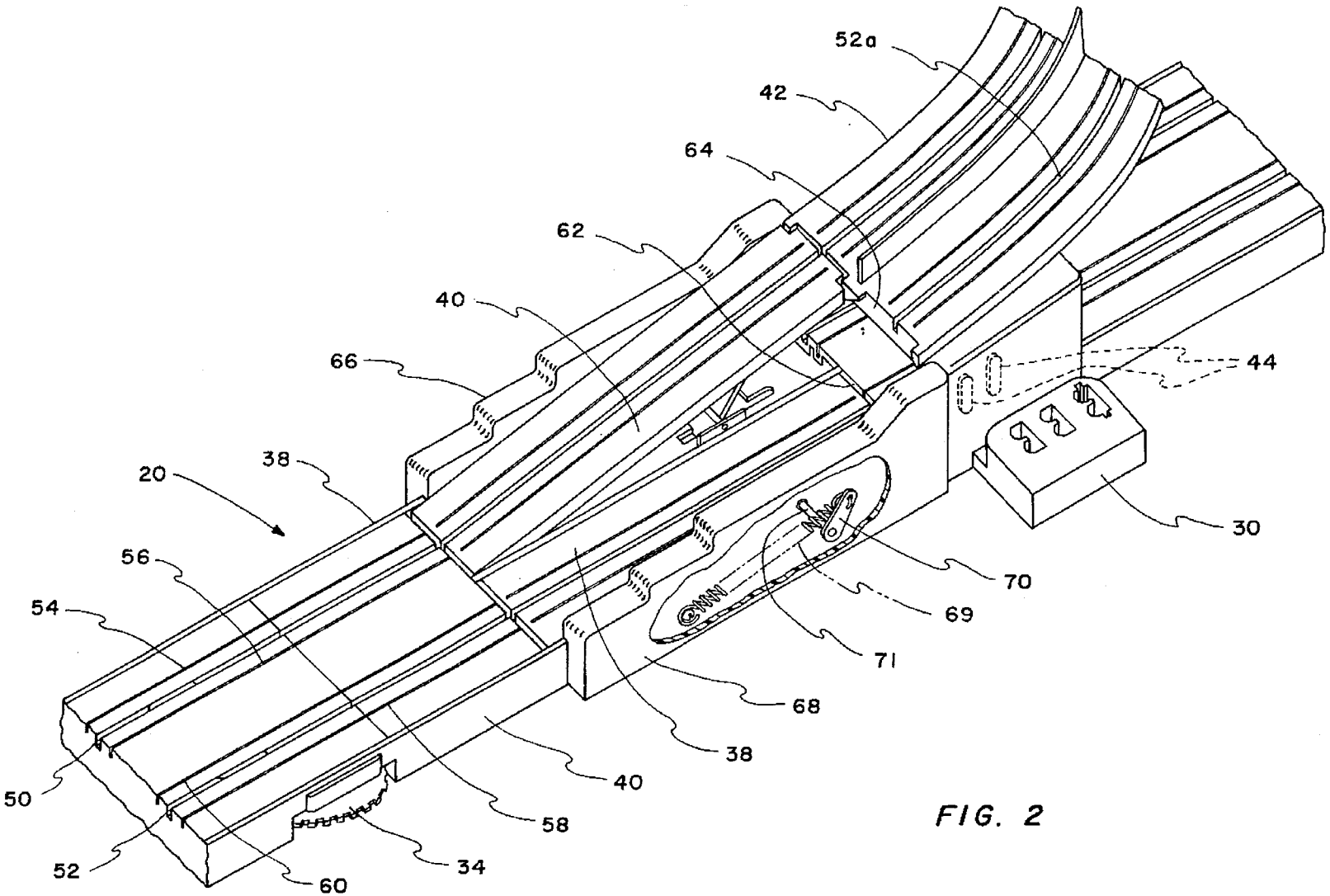
FIG. 2 is a perspective view of the inventive spring biased hinged track section featuring an escape ramp.

FIG. 2 is a perspective view of the inventive "escape" ramp mechanism. The roadway 20, in this example, includes two slot tracks 50, 52 which extend over the entire closed loop roadway 20 for enabling the two cars to race each other. If more cars are to race, any suitable number of additional slot tracks may be provided on the roadway. A pair of metal rails, 54–60 are positioned on opposite sides of each of the slots 50, 52 for energizing motors in the racing cars via shoes (not shown) mounted on the bottoms of the cars and sliding along the rails. The battery power is applied to these rails 54–60 via hand held controllers 26, 28 (FIG. 1) plugged into sockets in the terminal block 30. Each controller has a simple potentiometer which may increase or decrease the voltage applied to the rails, up to the maximum battery voltage. Therefore, each child can control the speed of his car by a suitable manipulation of the controller.

The escape ramp 42 is attached to the tops of sidewalls 66, 68 which in turn are attached, at their bottoms, to the closed loop track roadway 20. A latch mechanism normally holds the hinged track sections 38, 40 in a down position and against a spring bias. The energy for causing the track section to snap up is supplied by an individually associated spring, such as 69, concealed inside the side walls 66, 68. The spring 69 is connected to one end of a crank arm 70, the other end of which is connected to an axle shaft 71 which rotates responsive to changes in the position of the hinged track sections 38, 40, such as 40. When the hinged section is pushed down axle 71 rotates and crank arm 70 stretches spring 69. When the hinged section is released, the stretched spring 69 pulls crank arm 70 which rotates axle shaft 71 and raises the hinged section 38 or 40. The mechanism for hinged section 40 is the same as that shown in FIG. 2 and is concealed in side wall 66.

When the winning car trips the hold down latch, the spring 69 bias causes the released hinge section 38 or 40 to snap to a raised position. For example, if the car riding in slot 52 wins the race, the lap counter 34 reaches a zero count and the track section 38 snaps to a raised position with the track end 62 fitting flush with track end 64 on the escape ramp 42. Hence, the car riding in slot 52 continues from slot 52 into slot 52*a* and flips off the end of the escape ramp 42, thus causing the winning car to fly away and "escape" or leap from the track.

As the track section 38 (for example) is released to snap up, the track section 40 (for example) is latched in a lowered position, or visa versa if track section 40 is released. Thus, a losing car running in a locked down track section does not escape, but continues around the closed loop track roadway 20.

The vertical clearance space between edge 62 on roadway 20 and edge 64 on the escape ramp 42 is sufficient for the racing cars to pass through a tunnel under the escape ramp 42. Two contacts 44, 44 on the bottom of escape ramp 42 are connected directly to battery to apply maximum power to the racing car which is driven at its maximum speed off the end of the ramp.

Figure 5:
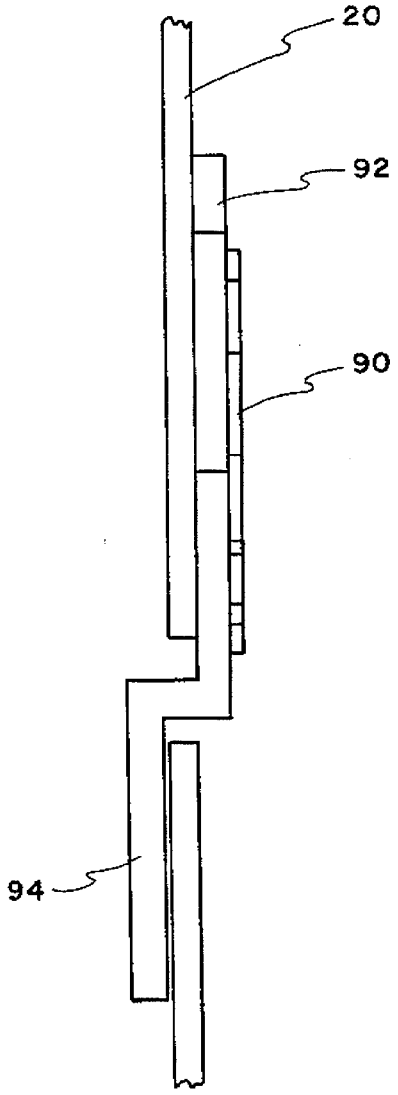
FIGS. 5 and 6 are a side elevation and a plan view, respectively, of an escapement mechanism which enables the lap counter to count down to zero.
Figure 6:
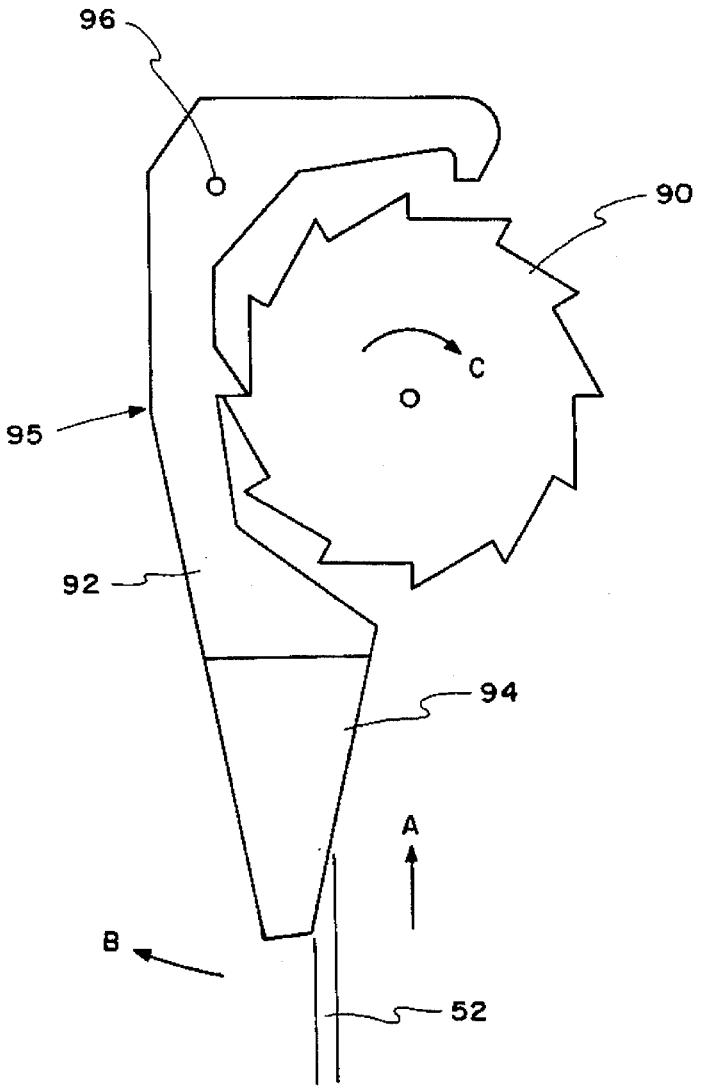
Figure 9:
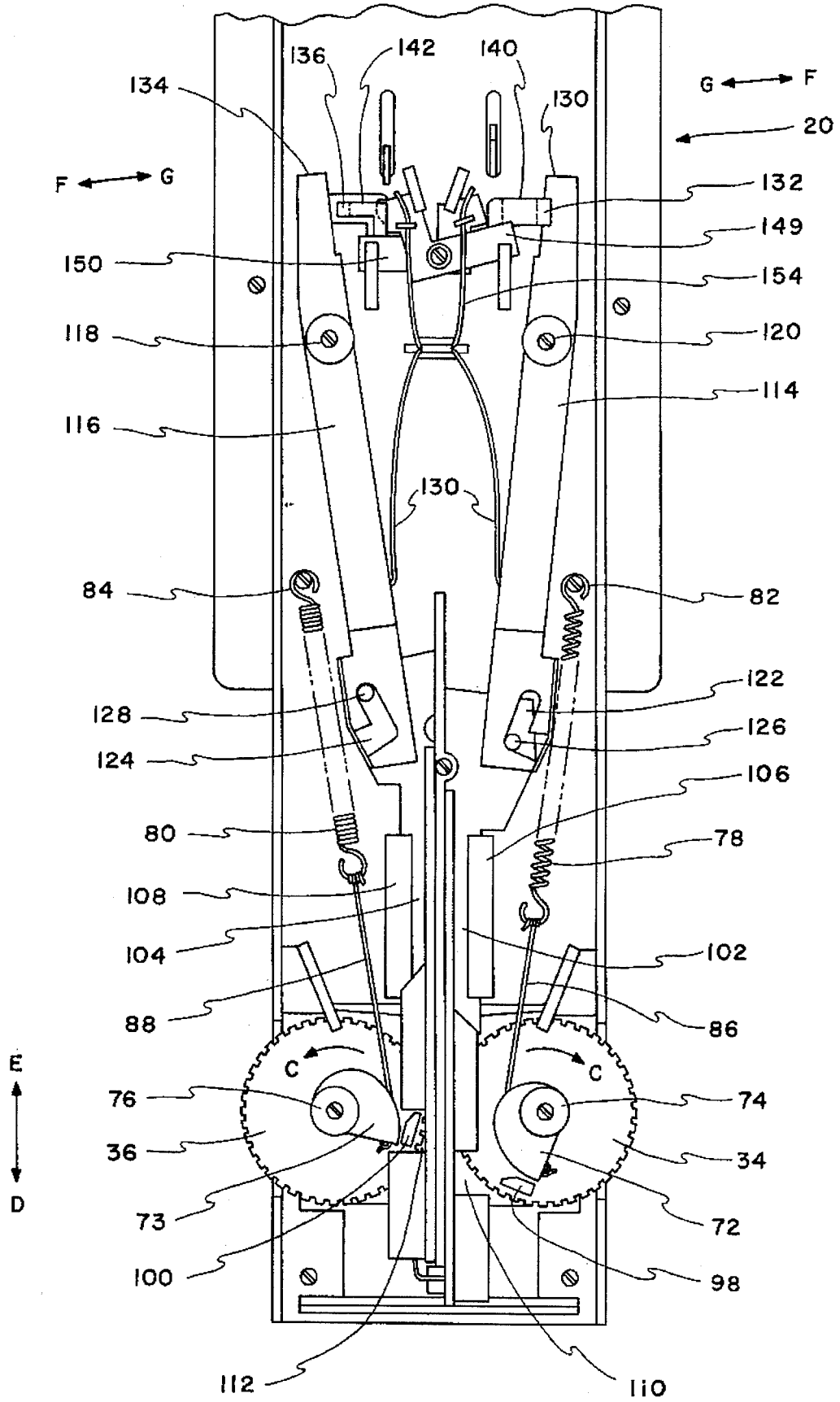
FIG. 9 is similar to FIG. 7 and shows the escape track with one section in a lock out position.

FIGS. 5, 6, 9 show the details of the lap counters 34, 36. Each track has a rotary thumb wheel 34, 36 individually associated therewith and mounted to rotate about hubs 74, 76, respectively, fixed to the bottom of the roadway 20. The thumb wheels carry numbers on the side shown in FIG. 1, which are exposed to view in order to identify the number of laps that remain in the race. The exposed numbers reduce one digit when each lap is completed. A cam 72, 73 is individually associated with and affixed to each of these thumb wheels 34, 36. A pair of coiled springs 78, 80 is individually connected between connection points 82, 84 on the bottom of roadway 20 and monofilament strands 86, 88 (similar to a fishing line). The monofilament strands 86, 88 wrap around cams 72, 73, respectively.

Therefore, as the thumb wheels 34, 36 are rotated, the monofilament is wound around cams 72, 73 respectively, in order to stretch the individually associated springs 78, 80. These stretched springs keep a contact spring bias on an escapement mechanism shown in FIGS. 5 and 6. A star wheel 90 (FIG. 6) is fixedly attached to a side (opposite that seen in FIG. 9) of each of the thumb wheels 34, 36. The position of the star wheel is controlled by an escapement bar 92 having a tab 94 extending into the slot 52. The escapement bar 92 is rotatable about an axis formed by a post at 96 on the bottom of the roadway. Therefore, every time that a car traveling in direction A passes through slot 52 it encounters tab 94 which causes the escapement bar 92 to swing in direction B in order to cause star wheel 90 to take one stop in direction C.

After the car passes through this place in slot 52, the bias of a spring pushing in direction 95 causes the escapement bar 92 to return to the position shown in FIG. 6. One count has been subtracted from the number showing on the lap set thumb wheel 34 or 36 (FIG. 9), depending upon the track in which the car is traveling. This causes the thumb wheel to rotate in direction C. As the thumb wheel rotates, the monofilament line 86 or 88 (FIG. 9) unwinds slightly from the cam 72 or 73. On the periphery of each respective thumb wheel 34, 36 is an upstanding shuttle activating tab 98, 100.

A shuttle 102, 104 (FIGS. 7, 9) is individually associated with each of the hinged track sections 38, 40, respectively, and is mounted to slide back and fourth (directions D and E) under suitable guides 106, 108. Each shuttle 102, 104 has a window 110, 112 therein corresponding to the respective shuttle activating tabs 98, 100 which are upstanding on the thumb wheels 34, 36. When the lap counting thumb wheels 34, 36 are rotated to indicate that there are laps to go, the shuttle activating tab is moved out of window, as tab 98 is moved out of window 110. When the thumb wheel reaches the zero count, the shuttle activating tab fits into the window, as tab 100 fits into window 112 to push the shuttle 104 forward under the urging of spring 80 pulling monofilament 88 on cam 73. The activating tabs 98, 100, acting through windows 110, 112, selectively push the associated shuttle 102,104 forward (direction E), meaning that the car associated with the moving shuttle has won the race.

A release arm 114,116 individually associated with the shuttles 102, 104, respectively, is pivotally connected to the bottom of the slot track roadway 20 at the posts 118, 120. The release arms 114, 116 have "L" shaped slots 122, 124 which receive pins 126, 128 fixed on shuttles 102, 104. Therefore, the release arms may swing back and forth (Directions F, G) responsive to a movement of the shuttles 102, 104 causing pins 126, 128 to move back and forth in the "L" shaped slots 122, 124. The distal ends 130, 134 of release arms 114, 116 are normally urged outwardly (direction F) and away from the center of the track responsive to the urging of a spring 131, which places the pins 126, 128 in the heel of the L-shape slots (as shown at 126).

Figure 7:
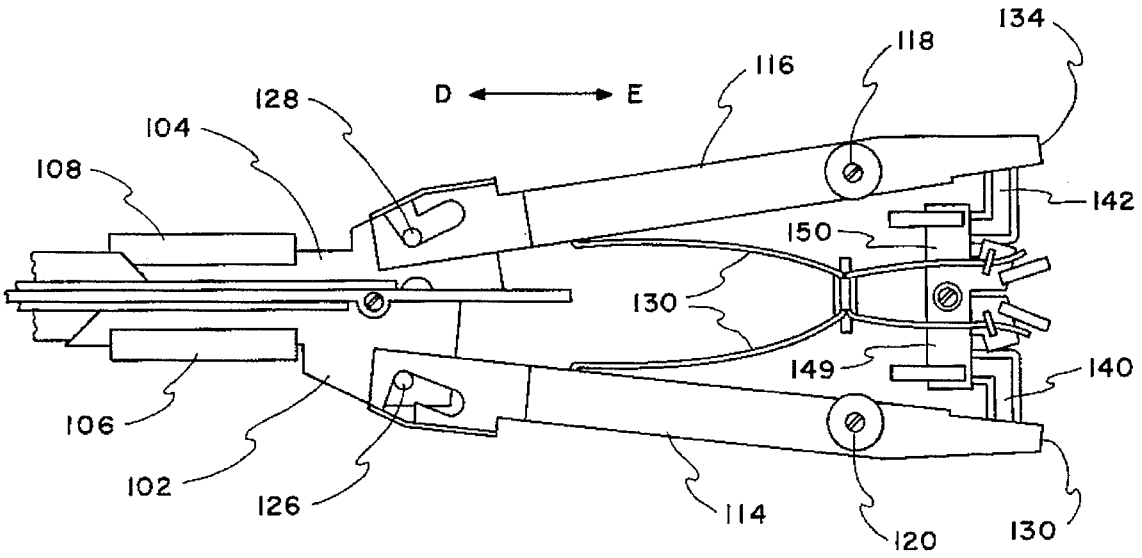
FIG. 7 is a plan view of a mechanism on the bottom of a slot track for controlling and enabling the hinged section to lock down or snap up to enable the winning car to reach an escape ramp.
Figure 8:
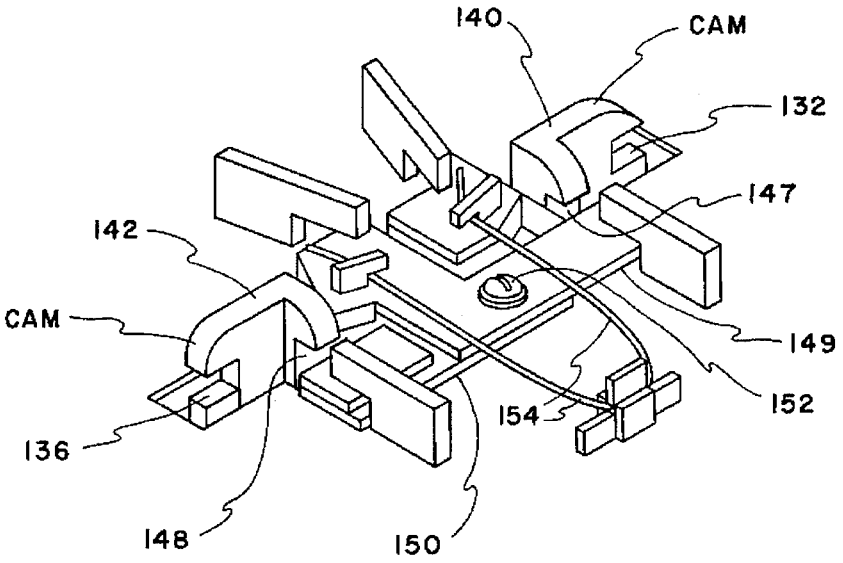
FIG. 8 is a perspective view of a mechanism for locking out the losing car so that it must continue around the closed loop and can not reach the escape ramp.

When the distal end 130 or 134 of a release arm 114 or 116 is urged (direction G) toward the center of the track by a movement (direction D) of the associated shuttle (as arm 114 is shown in FIGS. 7, 9), post 126 is moved into the heel of the L-shaped opening 122. The forward end 130 (for example) of release arm 114 is moved toward the center of the track (direction G) and into a keeper 132 or 136 on a hold down tab 140, 142 dependent from the bottom of a track section 38 or 40. When the forward end 134 (for example) of release arm 116 is moved away (direction F) from the center of the roadway 20 and toward the outside of the track, it is clear of the keeper 136 on the hold down tab 142, causing the associated track section 38 to snap up to the elevated position.

As long as the distal ends 130, 134 of release arms 114, 116 are in keeper 132, 136, the energy is stored in the springs, such as 69 (FIG. 2), inside the side walls 66, 68. As soon as the release arm 114,116 is removed from the keeper, this stored energy causes the hinged track section to snap up in order to guide the winning car onto the escape ramp 42.

Means are provided for locking the track section 38 or 40 in a down position when a car loses the race. More particularly, each of the two track sections 38, 40, has the hold down tab 140, 142 (FIG. 7), dependent therefrom. On the outside edges of the bottom ends of the hold down tabs 140, 142 are recesses shaped to provide the keepers 132, 136. The inside edges of hold down tabs 140, 142 are also recessed to provide keepers 147, 148 for the hold down tabs.

A spring loaded ramp lock comprises two somewhat L-shaped plates 149, 150 which are pivotally mounted on a common shaft 152 fixed on the bottom of the roadway 20. When the two track sections 38, 40 are in a down position, the two somewhat L-shaped ramp lock plates 149, 150 are held out of the way by the spring 154 and release arms 114, 116 so that they do not engage the keepers 147, 148. When one of the release arms 114, 116 moves away from the lock down position to the release position, the hinged track 38 or 40 of the winning car snaps up (FIG. 4), spring 154 moves the somewhat L-shaped ramp lock plate 149 or 150 associated with the other track into the keeper 147, 148 on the hold down tab 140, 142 for the loser's track section. For example, ramp lock 150 may move into keeper 148 which locks hold down tab 142 and prevents the associated hinged track section 38 from raising.

After the race is completed, the track is reset first by an adjustment of the lap counters 34, 36 away from the zero positions. This adjustment pulls back the shuttles 102, 104 in direction D which causes the ends 130, 134 of release arms 114, 116, to move toward the center of the track (direction G). Next, the raised track sections 38, 40 are pressed down. The hold down tabs 140, 142 on the pressed down track has a cam surface "CAM" which enables it to pass over the release arm. Thereafter, the release arm fits into keeper 132 or 136 to lock track sections 38, 40 in a down position.

Those who are skilled in the art will readily perceive how to modify the invention. Therefore, the appended claims are to be construed to cover all equivalent structures which fall within the true scope and spirit of the invention.

The claimed invention is:

1. A slot track raceway comprising a raceway for at least two cars, at least two side-by-side slots on said raceway for enabling at least two cars to race around said raceway, lap counter means individually associated with each of said slots and positioned so that each of said lap counters is responsive to a passing car in one of said slots, said lap counter means being set to establish the length of a race, said lap counter means counting down to zero in response to said cars passing a given location on said raceway, a separately hinged track section for each slot on said raceway, means for normally holding said hinged track sections in a position such that the cars continue to travel around said raceway after passing over the hinged track sections, an escape ramp associated with each slot on said raceway and positioned so that said escape ramps are accessible to said cars only when said hinged track sections are activated, means responsive to the first lap counter reaching a zero count for causing said hinged track section of the slot track raceway associated with that zeroed lap counter to divert the car racing in that slot onto said escape ramp, and means for locking the other hinged track section into said normal position so that the car in said other slot continues around said raceway.

2. The slot track raceway of claim 1 wherein said lap counter comprises a spring biased thumb wheel having an escapement mechanism including a star wheel, and means responsive to said cars passing said given location on the raceway for operating said escapement mechanism associated with the passing car in order to move said star wheel one step in a countdown direction.

3. The slot track raceway of claim 2 and a longitudinally movable shuttle associated with each slot, said shuttle being movable in reciprocal directions depending upon whether the lap count is storing a positive number or zero, and means responsive to the lap counter associated with said thumb wheel reaching zero for moving said shuttle, said movement of said shuttle unlatching a corresponding one of said hinged track sections.

4. The slot track raceway of claim 3 and a pivoted release arm associated with each of said shuttles, a hold down tab dependent from each of said hinged track sections, said dependent hold down tab having a keeper for engaging said release arm, and means responsive jointly to said lap counter storing a positive number and to a manual pressing down of a track section for causing said release arm to engage said keeper and lock said hinged track section in a down position, an end of said hold down tab having a cam surface for guiding and directing said release arm into said engagement with said keeper, said movements of said shuttle responsive to said zero count causing said release arm to move out of engagement of said keeper.

5. The slot track raceway of claim 1 and means for manually and individually controlling the speed of each car racing on said raceway, and means for applying full power to said diverted car while it is on said escape ramp whereby said car is at maximum speed when it is on said escape ramp.

6. A method of operating a slot track raceway having at least two side-by-side slot tracks on said raceway for enabling at least two cars to race around said raceway, separate lap counters for each individual slot track positioned so that each of said lap counters is responsive to a passing car in one of said slot tracks, and a hinged track section for each slot on said raceway, said method comprising the steps of:

setting said separate lap counter for each individual slot track in order to store lap numbers for establishing the length of a race, manually pressing said hinged track section for each individual slot track into an alignment position with said raceway while said lap counter individually stores a positive number, said hinged track then latching in said alignment position, manually controlling the speed of said cars while they are racing along said raceway, counting down said stored lap numbers to zero responsive to each passing of a car over a given location on said raceway, responding to the first count down to zero on any one of said individual slot tracks by diverting a car on said one slot track away from said raceway, said diverted car being on the first slot track to reach said zero count, and locking any other of said individual slot tracks in said alignment position so that any other car on said raceway is forced to continue to run on said raceway.

7. The method of claim 6 and the added step of suppressing said manual control of said speed after said diversion of said one car by then applying full power to said diverted car.

8. A slot track raceway comprising two side-by-side closed loop tracks whereby two cars may be raced against each other by circling said closed loop tracks of said raceway, means for separately applying power to each of said tracks via manual control means which individually controls the speed of each car by varying a voltage applied to said tracks, lap counter means which may be set to count down a selected number of laps responsive to each completion of a lap around said closed loop, a spring biased hinged track section means individually associated with each track in said closed loop for selectively diverting a car racing over said closed loop, means for normally locking said hinged track section in a position for closing said loop, means comprising at least one lever arm for releasing said spring biased hinged track section in response to said lap counter reaching a zero count down position, a ramp section individually associated with each of said hinged track sections, said spring bias causing said released track section to snap into an alignment with the associated ramp section whereby said diverted car runs onto said ramp section, means for applying full power to said car while on said ramp section for running said car at maximum speed, and means also responsive to said counter reaching said zero position for locking said hinged track section on the other of said closed loops in said alignment with said closed loop track.

* * * * *